US006615565B2

(12) United States Patent
Dekker

(10) Patent No.: US 6,615,565 B2
(45) Date of Patent: Sep. 9, 2003

(54) APPARATUS FOR PACKING BOARDS

(75) Inventor: Thomas J. Dekker, Eatons Hill (AU)

(73) Assignee: Boral Australian Gypsum Limited, Queensland (AU)

( * ) Notice: Subject to any disclaimer, the term of this patent is extended or adjusted under 35 U.S.C. 154(b) by 0 days.

(21) Appl. No.: 09/974,523

(22) Filed: Oct. 10, 2001

(65) Prior Publication Data

US 2002/0044857 A1 Apr. 18, 2002

Related U.S. Application Data

(60) Provisional application No. 60/239,520, filed on Oct. 11, 2000.

(51) Int. Cl.[7] ..... B65B 11/58

(52) U.S. Cl. ..... 53/399; 53/445; 53/155; 53/582; 53/441; 53/556; 414/789.6; 414/331.13; 414/280

(58) Field of Search ..... 53/443, 445, 447, 53/448, 399, 580, 582, 441, 556, 154, 155, 540, 541; 414/788.8, 789.6, 331.13, 331.01, 280

(56) References Cited

U.S. PATENT DOCUMENTS

| | | | | | |
|---|---|---|---|---|---|
| 3,292,783 | A | * | 12/1966 | Quist et al. | 414/789.6 |
| 4,092,815 | A | * | 6/1978 | Rowley et al. | 53/399 |
| 4,925,361 | A | | 5/1990 | Ellis et al. | |
| 5,224,325 | A | * | 7/1993 | Takahashi et al. | 53/443 |
| 5,406,770 | A | * | 4/1995 | Fikacek | 53/155 |
| 5,542,805 | A | | 8/1996 | Lisec | |
| 5,604,715 | A | | 2/1997 | Aman et al. | |
| 5,636,966 | A | * | 6/1997 | Lyon et al. | 414/789.6 |
| 5,720,157 | A | * | 2/1998 | Ross | 53/445 |
| 5,943,841 | A | * | 8/1999 | Wunscher | 53/154 |
| 6,460,314 | B1 | * | 10/2002 | Girard et al. | 53/580 |

FOREIGN PATENT DOCUMENTS

| | | |
|---|---|---|
| AU | 490215 | 7/1977 |
| EP | 0 205 064 B1 | 12/1986 |
| EP | 0 675 060 B1 | 10/1995 |
| JP | 58130803 | 8/1983 |
| JP | 8165028 | 6/1996 |
| JP | 11268804 | 10/1999 |

OTHER PUBLICATIONS

International Search Report for International Application No. PCT/AU01/01005.
Australian Patent Office—International Search Report, Search Date Dec. 2000.

* cited by examiner

*Primary Examiner*—Stephen F. Gerrity
(74) *Attorney, Agent, or Firm*—Alix, Yale & Ristas, LLP

(57) ABSTRACT

Apparatus for packing a pack of boards, eg plaster board, for wrapping and then delivery to a site is disclosed. The apparatus 1 comprises broadly about 30 to 40 board storage units or bins 2, 3 arranged in two sets. Each bin 2, 3 stores a different size and specification of plasterboard. The apparatus 1 also includes a conveyor 4 onto which the boards are tipped from the bin 2, 3 and which conveys the boards from the bins 2, 3 to a packing point. The apparatus 1 also includes a stacker 5 at the packing point for stacking the boards and also attaching for tying the boards together to form a single pack suitable for transport to the site.

48 Claims, 10 Drawing Sheets

SECTION II·II

SECTION III·III

APPARATUS FOR PACKING BOARDS

CROSS REFERENCE TO RELATED APPLICATION

This application claims the benefit of U.S. Provisional Application No. 60/239,520, filed Oct. 11, 2000.

FIELD OF THE INVENTION

This invention relates to apparatus for packing a pack or lot of boards. This invention also relates to a method of packing a pack of boards. This invention also relates to a board storage unit for use in the apparatus.

This invention relates particularly but not exclusively to apparatus for handling packs or lots of boards for use in building construction, eg plasterboard and fibre-cement boards. It will be convenient to hereinafter describe this invention with reference to the example application of packs of these boards. However it is to be clearly understood that it is capable of other applications, and in particular it is suitable for handling and packing other types of boards.

In the specification the term plasterboards shall be interpreted broadly. For example plasterboards shall be interpreted to include boards made of fibre-cement and also other boards used in building construction.

BACKGROUND TO THE INVENTION

Sheets of board and in particular plasterboard are used widely in building construction, particularly residential buildings and commercial buildings. For example plasterboard is used to line the internal walls and ceilings of buildings providing the interior surface finish. Other boards, eg fibre-cement boards may be used for specific rooms, eg the bathroom or kitchen, but plasterboard is used for most of the walls.

During construction the boards are supplied on site in the form of packs or lots of boards which are supplied as a single pack to the construction site. Each pack will comprise 50 to 100 boards each with a specific material, size and thickness specification. Individual houselots with their specific requirements for boards of a certain dimension and thickness are assembled or made up at a factory or distribution point and then delivered to the site in a single delivery.

Currently a large amount of manual handling is required to assemble houselots of boards at a distribution point. Individual boards would typically be lifted by a pair of packers, eg persons, who select a predetermined board type and size from a supply of boards and then stack the boards in a manner that facilitates presentation of the load to a forklift truck for loading onto a transport vehicle. There are compelling reasons to reduce the amount of manual handling of boards in the process of assembling a houselot. The weight of individual boards can exceed limits laid down by Workplace Health & Safety Regulations in at least some areas. The lifting of these boards by workers is therefore undesirable. Further the manual handling of the boards leads to high levels of pedestrian traffic on the floor which increases the potential for collision between these pedestrians and forklifts, which is a major source of industrial accidents in these environments.

In addition the process of assembling a pack of boards in this fashion is very labour intensive and it would be advantageous if the labour cost of this assembling process could be reduced making it more efficient.

It would also be advantageous if the boards in a given houselot could be sequenced or ordered in a specific order to ease the amount of handling required at the construction site. That is it would be advantageous to receive the boards in the order in which they would be used by a plasterer on site. This aspect in addition would lead to further productivity increases and cost savings in terms of the labour cost of building a house.

Accordingly it would be advantageous if apparatus could be provided for taking boards out of bins storing the boards, moving them to a packing point where they are stacked into a neat pack and then strapping them together to form a single pack which can be presented to a forklift truck for lifting onto a transport vehicle. It would also be advantageous if the process was automated and had a processing means for calculating the sequence in which boards were drawn from the bins.

SUMMARY OF THE INVENTION

According to one aspect of this invention there is provided apparatus for packing boards, the apparatus including:

- a plurality of board storage units each storing a plurality of a specific size and specification of board, each board storage unit having means for dispensing a board in the board storage unit; and
- a conveyor for conveying the boards in sequence from the various board storage units to a packing point such that a lot or pack of boards can be formed at the packing point comprising boards of desired sizes arranged in a desired sequence.

Thus in its broadest form the invention comprises selecting sheets of different sizes in sequence from the various board storage units and transferring them to a packing point such that the pack or batch ultimately formed at the packing point comprises boards of desired sizes arranged in a desired sequence.

The apparatus may also include selector means for determining the sequence in which boards are drawn from the board storage units and controlling dispensing of the boards from the storage units by activating the appropriate board storage units in turn to dispense the boards.

The selector means may also include a processing means that is a computer programmed with appropriate software for determining the sequence of boards in the pack or lot based on information entered into the computer.

Thus the apparatus also determines the sequence in which boards are drawn from the board storage units based on information which is entered into the processing means, eg by a customer.

This enables the boards arriving at the packing point to be ordered in a particular sequence, eg an order which is favourable to the user which typically would be a plasterer on a building site. It may also take into account the shape of the pack of boards for loading on to a truck.

Applicant has determined that 95% of boards for the typical houselot can be supplied from 40 board storage units, eg bins, each having a different sized board therein. Typically the boards have a length in the range of 2.4 meters to 5–6 meters, and a width of 1.2 meters to 1.35 meters.

Thus the pack is made up by drawing different sized boards in a desired sequence from the respective bins and transferring these in turn on the conveyor means to the packing point.

The apparatus may have at least 20 said board storage units, preferably at least 30 said board storage units, more preferably 38 to 42 board storage units and the board storage units may be sized to accommodate boards having a length of 2.4 meters to 5–6 meters and a width of 1.2 meters to 1.35 meters.

Each board storage unit or bin may be pivotable between a passive position in which the boards are horizontally extending and an active discharge position in which the boards are substantially vertically extending, and a leading board can be tipped or pushed on to the conveyor.

Typically the boards are loaded into each bin for subsequent use in forming a pack when the storage unit is in the passive position and after the loading is completed the unit is moved to the vertically extending operative position.

Each board storage unit may include advancing means for advancing the boards in the unit to a position where the board in the leading position can be tipped on to the conveyor, and lifting means for lifting the board occupying the leading position upwardly such that an upper edge thereof projects upwardly proud of the remainder of the boards in the unit.

The lifting means may comprise a resilient biasing means for lifting the leading board upwardly proud of the remainder of the boards in the unit.

The resilient biasing means may be a spring and the biasing force may be exerted more or less constantly on the board once the board is advanced to the leading position by the advancing means.

Each board storage unit may include dispensing means for detaching the leading board in the unit from the remainder of the boards and tipping the leading board onto the conveyor means. The dispensing means may include detaching means for detaching the raised leading board from the remainder of the boards and also tipping means for tipping the leading board onto the conveyor means.

In turn the detaching means may conveniently include a mechanical pusher for pushing the upper edge of the leading board in a direction away from the other boards and towards the conveying means. The tipping means may include a pneumatic blaster for issuing a blast of air at the upper edge of the leading board once it has been detached from the remainder of the boards to tip it onto the conveyor.

In one form the plurality of board storage units comprises two sets of storage units each of which comprises two rows of units with the conveyor means extending between the rows of units. Further the bins of each set may be located on two levels.

The conveyor may comprise a storage unit conveyor portion conveying the boards from the storage units to associated storage unit end points, a second conveyor portion conveying the boards laterally inwardly from said bin end points to a single transfer point, and a third conveyor portion conveying the boards longitudinally from the transfer point to the packing point.

Conveniently the storage unit conveyor portion may include belts that are suited to grip and hold boards thereon when the boards are tipped onto the belts. Belts are preferred because of their ability to grip and carry the boards. The second conveyor portion comprises one or more laterally extending conveyor sections that comprise a plurality of spaced narrow belts for moving the boards laterally from the storage unit end points to the single transfer point. The third conveyor portion comprises transverse rollers rotating in a direction towards the packing point which transfer the boards from the transfer point to the packing point, and the third conveyor portion also aligns the boards before they arrive at the packing point.

The apparatus may further include means for stacking the boards making up the pack or lot in a single stack with the boards broadly horizontally extending and substantially aligned with each other and with the boards stacked in the order in which they are drawn from the board storage units.

The stacking means may include a support for supporting the boards forming the stack and also a vacuum conveyor mounted on the support spaced above the stack for attaching the boards arriving at the packing point thereto by means of a suction attachment and drawing the boards across the stacking means into a stacking position where the board is superimposed over the stack, eg laterally and longitudinally aligned with the stack. Typically the vacuum stacking conveyor releases the board attached thereto when the board is in the stacking position by interrupting the vacuum applied to the vacuum conveyor.

The vacuum stacking conveyor may comprise an endless conveyor with suction cups projecting outwardly therefrom at intervals across the surface of the conveyor, the suction cups applying a suction attachment to the boards when they come into contact therewith.

Typically lengths of cornice are added to the pack, eg at the stacking means to complete the customer order.

The apparatus may further include a pack transfer conveyor for conveying the pack of boards formed by the stacking means to a discharge point, eg where the pack is finally lifted by a forklift truck onto a truck for transport to site.

The pack transfer conveyor may conveniently be in the form of a roller conveyor comprising a plurality of closely spaced rollers extending transversely to the direction of travel of the pack and rotating in the direction of the travel of the pack to advance the pack from the stacking means to the discharge point. The pack transfer conveyor is required to carry a load of several tonnes which is substantially heavier than the individual boards carried by the first conveyor.

The apparatus will typically also include means for attaching the pack of boards to each other to form a single article suitable for transport to a site where it is to be used. The attaching means usually comprises a strapping applicator positioned adjacent and downstream from the stacking means.

The attachment means typically also includes means for applying a cover sheet to the pack to fully enclose or encase the pack to seal it off from the ingress of moisture downstream of the strapping applicator. It is particularly important that the plasterboard does not get exposed to moisture when being transported from the distribution point to the houselot.

The apparatus may also include means for enclosing the pack in shrink-wrap to supplement the cover sheet and means for presenting the load conveniently for pick up by a fork lift truck at the discharge point.

According to a second aspect of this invention there is provided a method for assembling and wrapping a pack of boards so as to produce a single wrapped pack that can be transported to a building site, the method including:

- selecting individual boards having specific dimensions in turn from one of a plurality of board storage units, each unit holding a specific size of board;
- dispensing the selected boards from the board storage unit onto a conveyor as they are selected; and
- conveying the boards on the conveyor in the sequence in which they are selected and dispensed to a packing point where they can be stacked to form a pack of boards.

The method may conveniently also include the step of calculating a preferred order in which boards of different sizes are selected and then dispensed from the board storage units.

Advantageously the method includes the further step of taking the boards off the conveyor as they are delivered to the packing point and depositing them onto a stack forming the pack of boards. The boards may be taken off the conveyor by means of stacking means including a vacuum conveyor.

The method may also include strapping the boards together to form a single pack after they have been formed into a stack. The method may also include the step of covering the pack with a cover sheet and also with a shrink wrap.

The method may also include the final step of transferring the strapped pack with a cover sheet and shrink-wrap to a transfer point where it can be picked up and deposited in a truck.

According to a third aspect of the invention there is provided a board storage unit for receiving a plurality of boards of a single size, the unit including:

a base;

a support for boards loaded into the storage unit, the support being mounted on the base;

means for pivoting the support between a passive position in which the boards are horizontally extending and an active discharge position in which the boards are vertically extending;

lifting means for lifting a leading board from those stored in the unit upwardly proud of the remainder of the boards when the unit is in the active discharge position; and dispensing means for dispensing the leading board from the support and onto a conveyer.

Each unit is generally positioned in the active discharge position during normal operation of the unit but is moved to the passive position for loading of boards into the storage unit and after loading is moved back to the active discharge position.

Typically the pivoting means might comprise a hydraulic drive with a plurality of hydraulic rams.

The support member may include a first portion positioned under and supporting the boards in the passive position, and a second portion extending substantially perpendicularly to the first portion which is positioned underneath the boards in the active position and supports the boards.

The lifting means may comprise a resilient biasing means biasing the leading board upwardly proud of the remainder of the boards in the unit.

The resilient biasing means in one embodiment is a spring positioned under the board in the leading position, which applies a more or less constant force on the board in the leading position.

The dispensing means may include detaching means for detaching the raised leading board from the remainder of the boards and also tipping means for tipping the leading board onto the conveyor means.

The detaching means may include a mechanical pusher for pushing the upper edge of the leading board in a direction away from the other boards and towards the conveyor.

The tipping means may include a pneumatic blaster for issuing a blast of air at the leading board once it has been detached from the remainder of the boards to tip it onto the conveyor.

The unit may further include an overhead support member moveable relative to the bin towards and away from the conveyor, and the mechanical pusher and the pneumatic blaster may be mounted on the support member in closely spaced relation to each other.

Thus the board storage unit provides storage for boards of a particular size and also the ability to separate off a leading board and tip it on to a conveyor on demand when it is required. The unit can easily be loaded with an inventory of boards by simply dumping them on the support member when it is in the passive position with the boards in a horizontally extending orientation.

The board storage unit may include any one or more of the features relating to this unit described above with respect to the first aspect of the invention.

According to a fourth aspect of this invention there is provided a stacking means for stacking boards arriving at a packing point into a single stack making up the pack with the boards horizontally extending and substantially in line with each other.

Typically the boards are stacked in the order in which they arrive at the packing point.

The stacking means may include a support for supporting the boards forming the stack and also a vacuum conveyor mounted on the supports spaced above the stack for attaching the boards arriving at the packing point thereto by means of a suction attachment and drawing the boards across the stacking means into a stacking position where the board is superimposed over the stack, eg laterally and longitudinally aligned with the stack.

The vacuum stacking conveyor may comprise an endless belt with suction cups projecting outwardly therefrom at intervals across the surface of the conveyor, the suction caps applying a suction attachment to the boards when they come into contact therewith.

Typically lengths of cornice are added to the pack, eg at the stacking means, to complete the customer order.

The stacking means may be associated with a transfer conveyor for conveying the stack of boards away from the stacking means.

Further advantageously the stacking means may be associated with a means for attaching a pack of boards to each other to form a single article suitable for transport, eg in the form of a strapping applicator.

The stacking means may also be associated with a means for applying a cover sheet to a pack and also enclosing the pack in shrink wrap.

DETAILED DESCRIPTION OF THE INVENTION

Apparatus for packing houselots of plasterboard in accordance with this invention may manifest itself in a variety of forms. It will be convenient to hereinafter describe in detail one preferred embodiment of the invention with reference to the accompanying drawings. The purpose of providing this detailed description is to instruct persons having an interest in the subject matter of the invention how to carry the invention into practical effect. It is to be clearly understood however that the specific nature of this description does not supersede the generality of the preceding broad description. In the drawings:

FIG. 1 is a schematic plan view of apparatus for packing a pack or houselot of plasterboards the apparatus being indicated generically by reference numeral 1.

Figure 1:
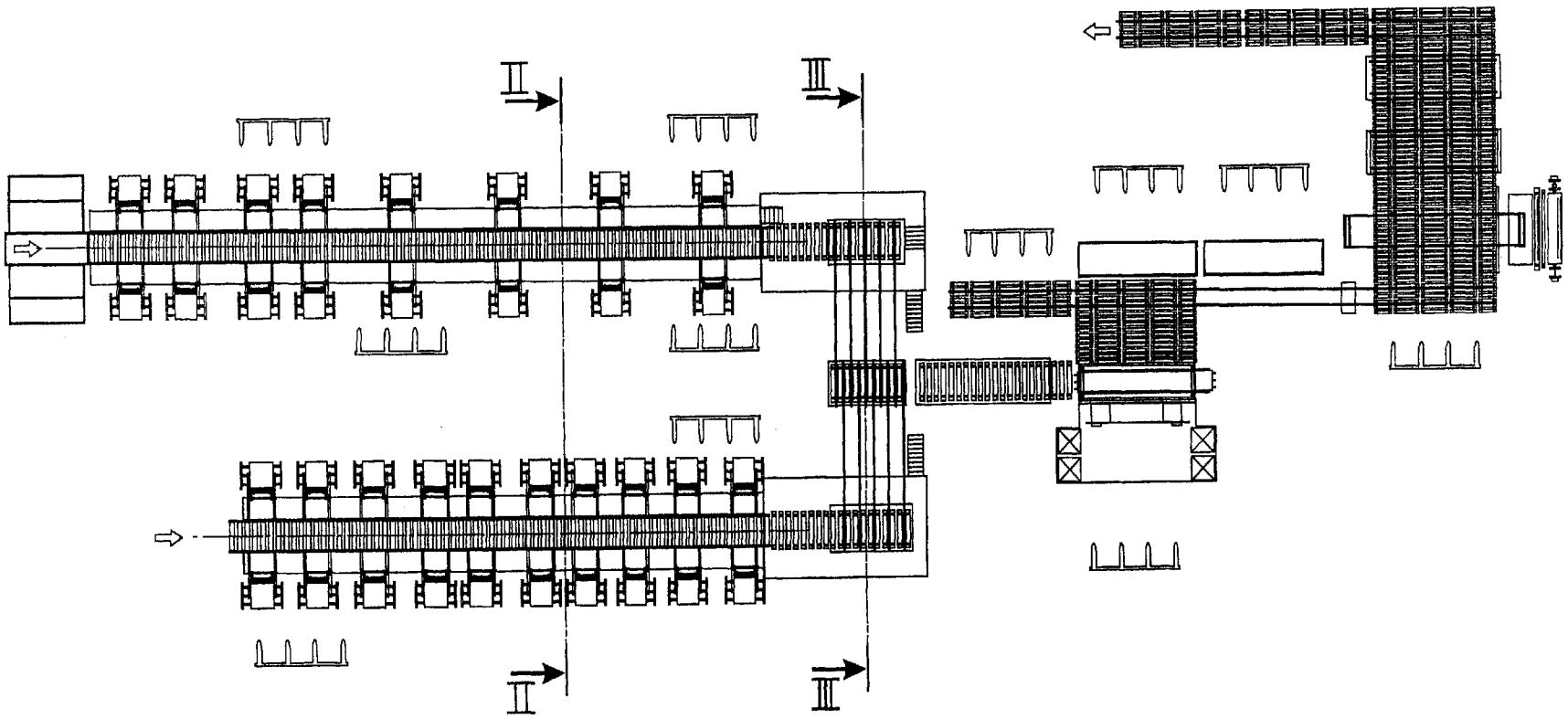
FIG. 1 is a schematic plan view of apparatus for packing a houselot of plasterboard.

The apparatus 1 comprises broadly two sets of board storage units 2,3 which are bins, a conveyor 4 comprising several discrete conveyor portions for conveying boards from the bins 2,3 to a packing point, and means for stacking the boards at the packing point in the form of a board stacker 5. The board stacker 5 forms the boards from the various storage units 2, 3 into a houselot. The apparatus includes a transfer conveyor 12 for conveying the pack from the stacker 5 to a pick up point. The apparatus 1 also includes means for attaching the boards in the lot to each other to form a single load in the form of a strapping applicator 8, a cover sheet applicator 9, a corner folder 10, and a shrink wrap applicator 11 positioned on the transfer conveyor 12.

The apparatus also includes processing means in the form of a computer with software for calculating the sequence in which the different sized boards are drawn from the different bins.

An order from a customer specifying the number and size of the various boards is entered in the computer which then calculates the pack sequence. The calculation of the sequence of the boards may also take into account load stabilisation and the like. Typically the computer will be a PC.

Figure 2:
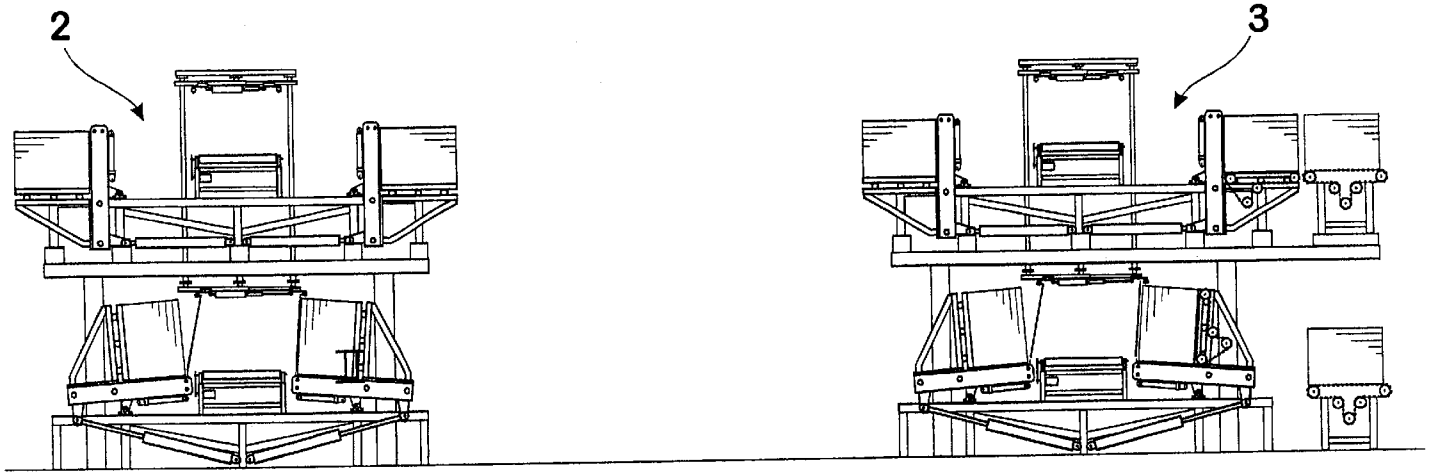
FIG. 2 is a sectional side view of the apparatus of FIG. 1, section through II—II.
Figure 3:
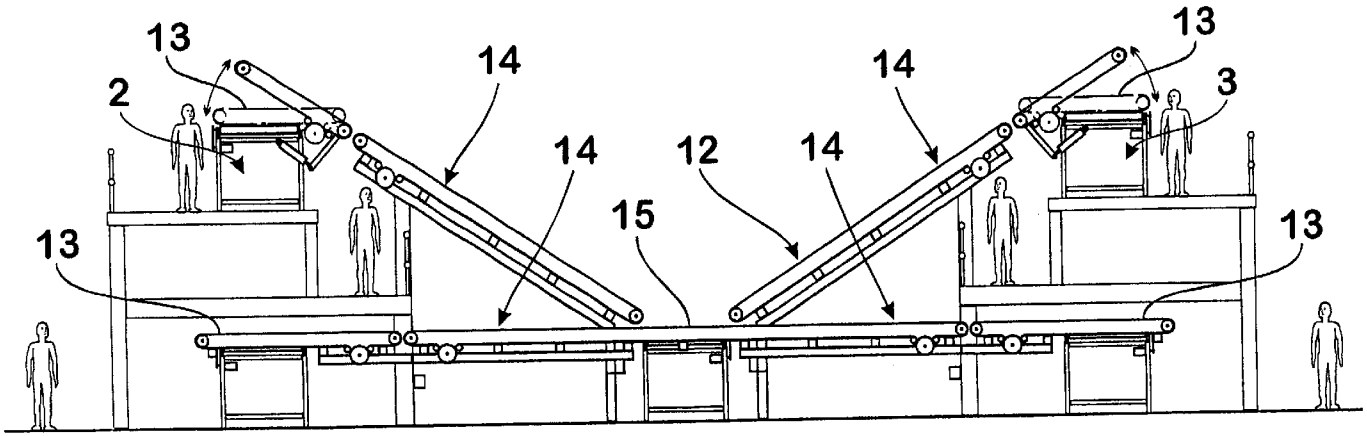
FIG. 3 is a further sectional side view of the apparatus of FIG. 1, section through III—III.

The board storage units are arranged on two levels as is shown in FIGS. 2 and 3 of the drawings. This is purely to save space as the surface area of the apparatus would have to be housed in a roofed factory which is a major cost.

Typically the apparatus will have about 40 bins, eg arranged broadly in two parallel rows laterally spaced from each other. It is to be understood that the storage units need not be positioned on two levels and the specific number of bins can vary.

The conveyor 4 comprises first portions 13 for each of the sets 2, 3, second portions 14 for each of the sets 2,3 and a third portion 15 transporting the boards from a transfer point at the ends of the second portions 14 to the board stacker 5.

The first portions 13 transfer the boards from the storage units 2, 3 to bin end points 17. FIG. 2 shows the orientation of the first portions 13 of the conveyors 4, ie basically horizontally extending across the width thereof.

The first conveyor portion is formed primarily from belts that have the ability to grip and hold the boards when they are tipped onto the belt. This is provided by the texture of the belt material which has a suitable coefficient friction.

The second conveyor portions 14 comprises parallel spaced narrow belts moving the boards laterally inwardly from the set end points 17 to a central transfer point 18. The second conveyor portion 14 may comprise both inclined belt conveyors moving boards downwardly at an angle to the central portion, eg from the upper level of bins, and a horizontal belt conveyor moving the boards laterally inwardly, eg from the lower level of bins. The second conveyor portion 14 is shown in some detail in FIG. 3.

The third conveyor portion 15 moves the boards from the central point 18 at the end of the second portions to the board stacker 5. The third conveyor portion 15 is comprised of rotating rollers. The boards are aligned towards the end of the third conveyor portion before they reach the packing point. The boards which are of varying width are aligned typically on the one side rather than centrally. This can be accomplished in many ways. One convenient way is to have skew rollers moving the boards up against an aligning formation on the side of the conveyor.

Boards from the board storage units on the upper level are transferred on to the inclined belt of the second conveyor portion 14 by tilting of parts of the conveyor as shown in FIG. 3.

Figure 6:
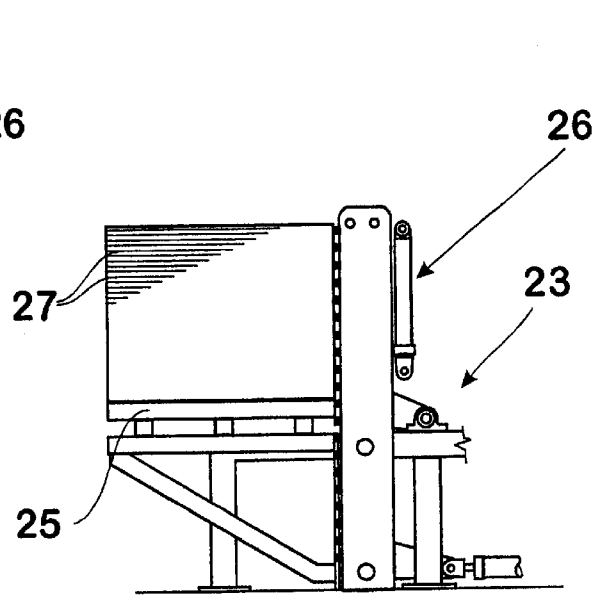
FIGS. 4 to 6 are schematic side views of a board storage unit for the apparatus in FIG. 1.
Figure 5:
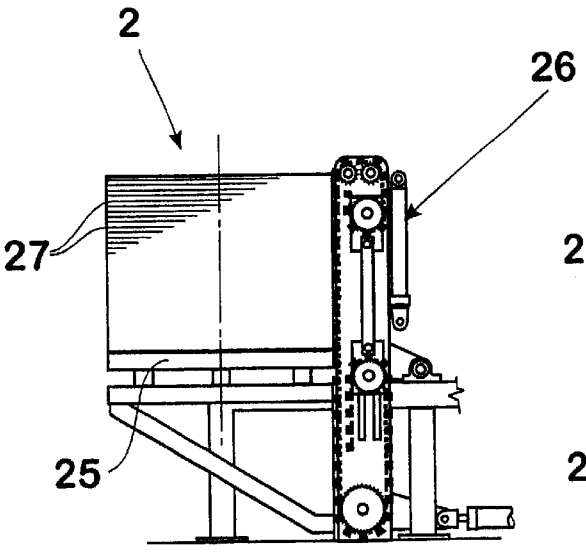
Figure 4:
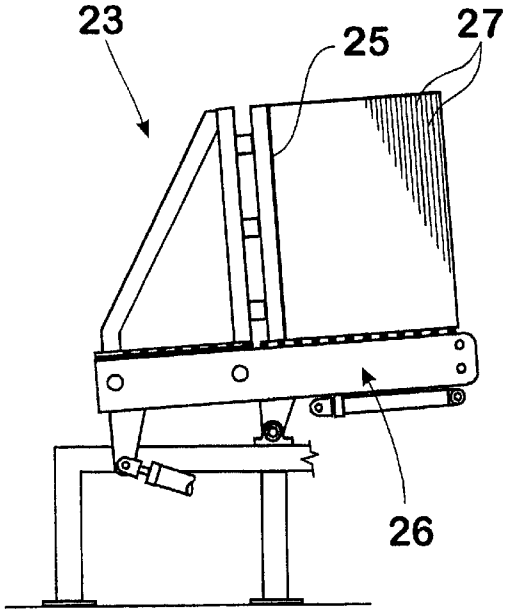

The structural detail of the tilting mechanism of the board storage units is shown more clearly and in more detail in FIGS. 4 to 6.

Each storage unit or bin 2, 3 comprises in essence a support member 25 on which boards 27 can be progressively stacked in a passive position with the boards horizontally extending, and a drive 26 for pivoting the support member 25 and stacked boards 27 into an active position in which the boards are in a vertically extending configuration. The support member 25 comprises a first portion positioned underneath the boards in the passive position and a second portion, substantially perpendicular to the first portion, positioned underneath the boards in the active position.

Figure 7:
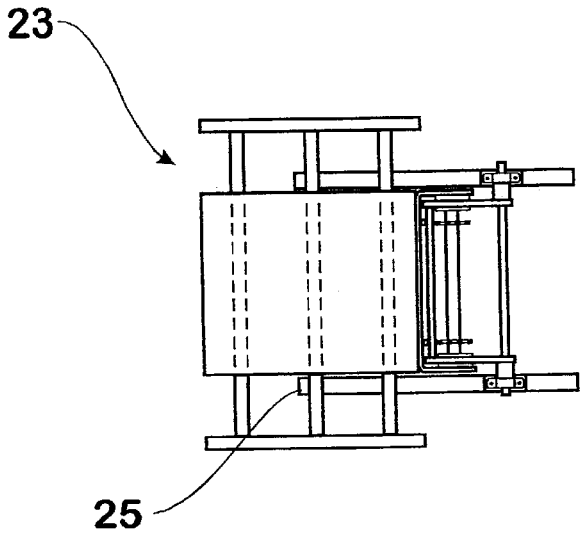
FIG. 7 is a front view of the storage unit of FIG. 4.
Figure 8:
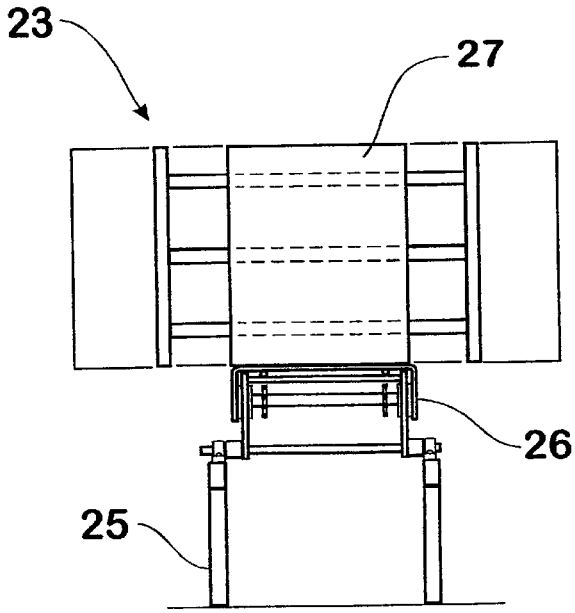
FIG. 8 is a top plan view of the unit of FIG. 4.

The bin 23 is moved to the passive position for loading the bin with boards and is thereafter moved to the active position where it remains until the bin needs to be filled with boards again. FIGS. 5 and 6 show the bins in the passive position whereas FIG. 4 shows them in the tilted or active position. FIGS. 7 and 8 respectively show front and plan views of more detail of the structural features of the bins.

Typically the bin 2, 3 is pivoted from the passive to the active position by a drive such as a hydraulic drive mechanism. In the illustrated embodiment the bin is supported on a pivot point and has adjustable hydraulic arms on either side of the pivot point. However many other drive mechanisms could be used such as a motor together with a chain drive. It is to be clearly understood that the specific nature of the drive is not essential and many other drive mechanisms may be used.

Figure 9:
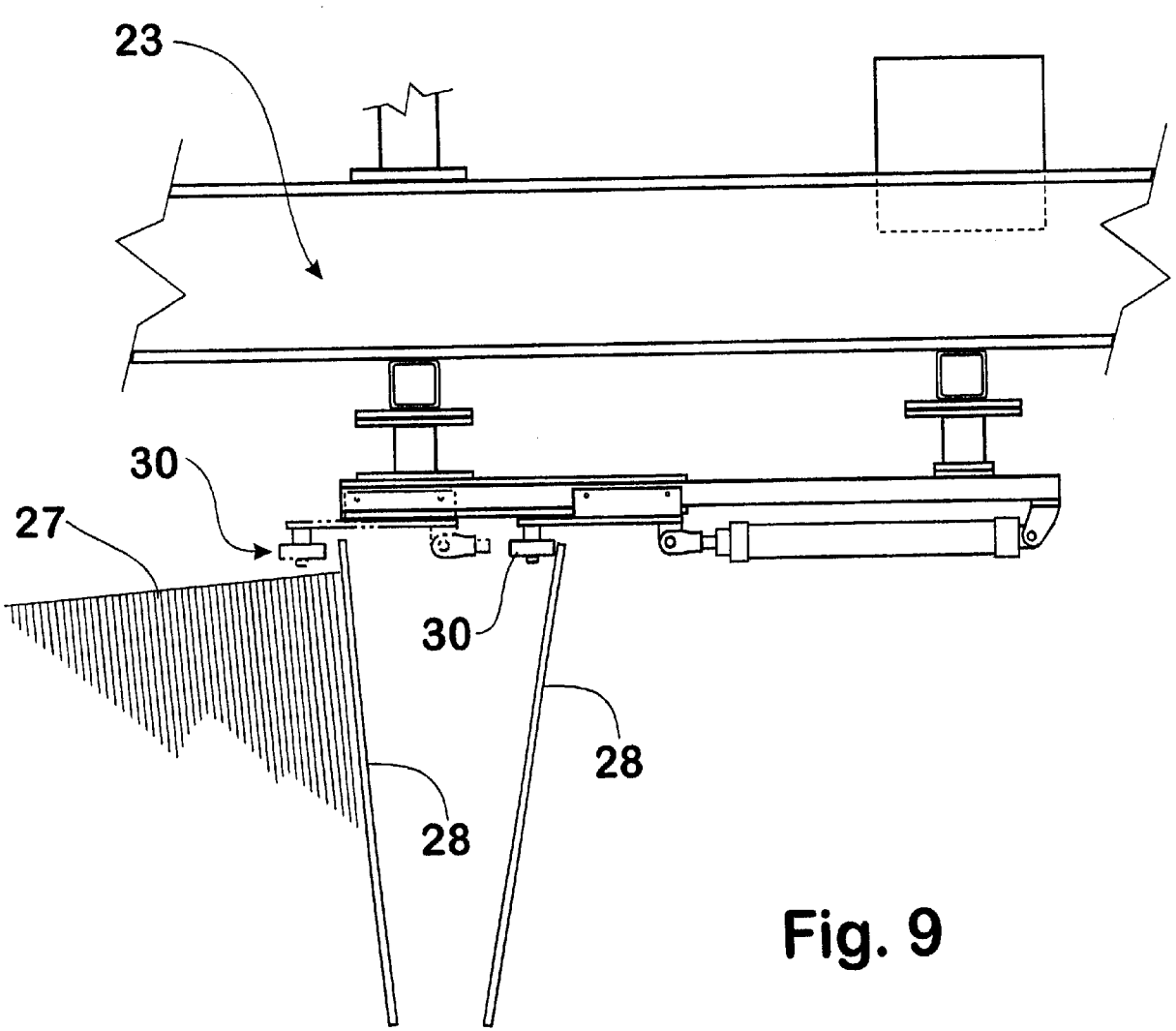
FIG. 9 is a schematic side view of the board detachment features of the storage units of FIGS. 4 to 8.

FIG. 9 shows the structural features and mechanism for detaching the leading board from the remaining boards when the bin is in the active position so as to deposit it on the conveyor 4. The upper edge of the leading board 28 is lifted proud of the remaining boards as is shown in FIG. 9 by a lifting element. The element is loaded by a spring under compression and displaces a board upwardly as soon as it moves to the leading position. Other means of lifting the leading board upwardly may also be used, eg a hydraulic lifting element.

The bin also includes a support for advancing the remaining boards in the bin forward such that the leading board always moves up to occupy the leading position when a board is dispensed. In the illustrated form the drive is an endless chain drive which moves forward in steps as required to fill the leading position. The chain drops away at the end of the support and thereby does not interfere with the dispensing of the board.

Figure 12:
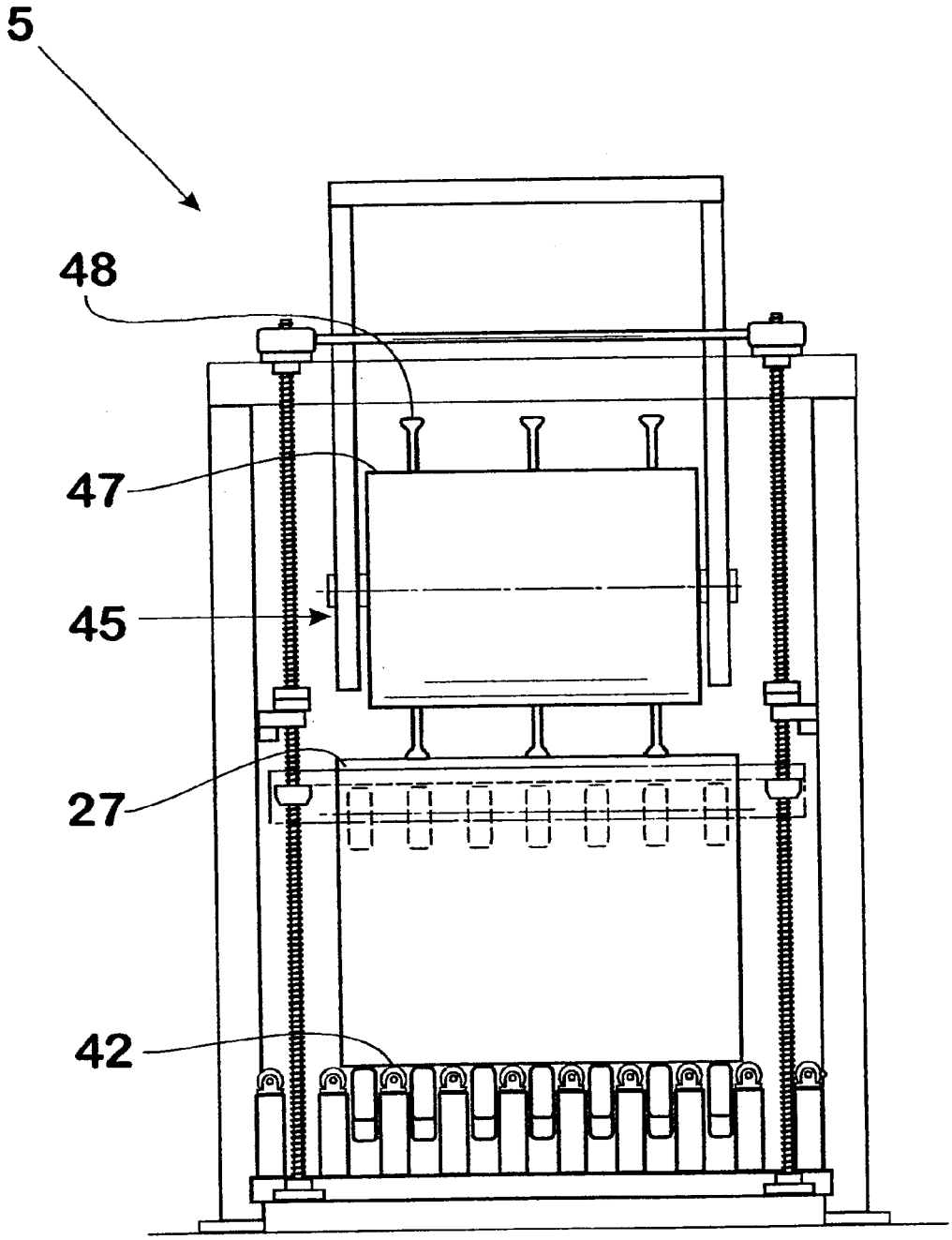
FIG. 12 is an end view of the board stacker of FIG. 4.

The bin also includes a mechanical pusher or puller 30 for pushing the raised upper edge of the leading board away from the other boards and towards the conveyor. The pusher 30 is applied against one corner of the board, rather than centrally or on both corners. It gently urges the leading board away from the other boards. It is important that the initial movement is gentle to assist in breaking the vacuum between the boards and so as not to break the board. Once the board has been detached the mechanical pusher moves more quickly to tip the board onto the conveyor. The mechanical pusher is shown clearly in FIG. 12. FIG. 12 also shows the leading board spaced away from the remaining boards and about to be tipped over on to the conveyor.

In one form an air pipe is used to blast compressed air into the space between the leading board and the next succeeding board as they are separated to assist in breaking the vacuum. However this is not used in current embodiments.

Figure 10:
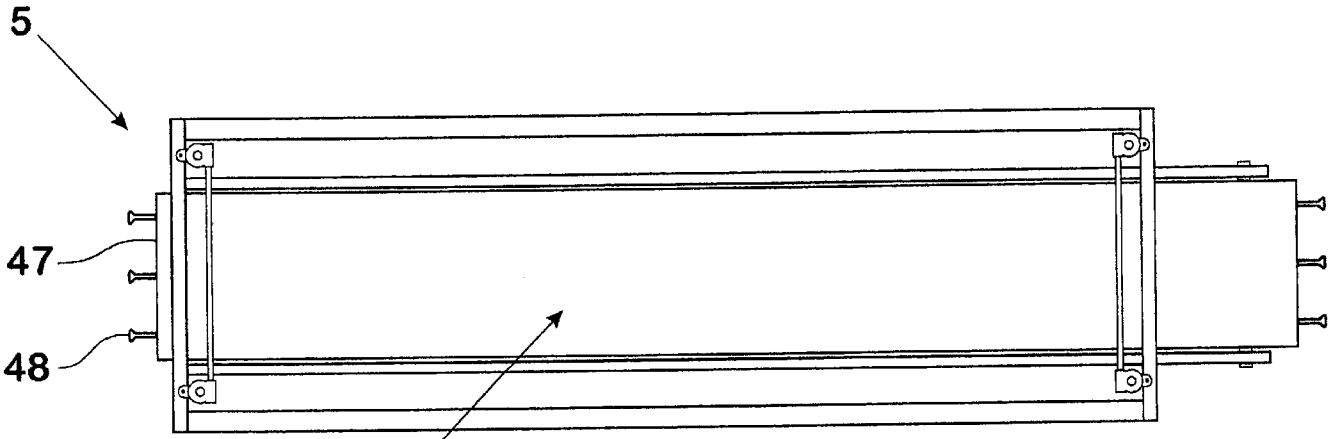
FIG. 10 is a plan view of a board stacker of the apparatus of FIG. 1.
Figure 11:
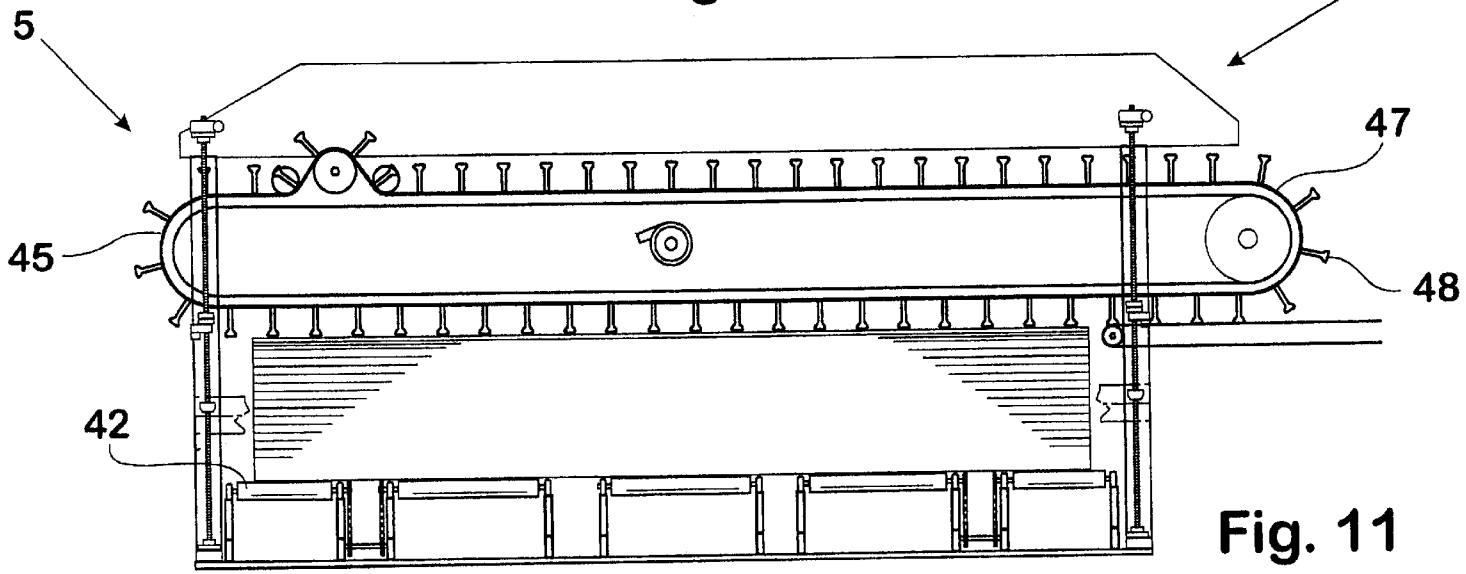
FIG. 11 is a sectional side view of the board stacker of FIG. 4.

FIGS. 10 to 12 show various views of the board stacker for the apparatus of FIG. 1. In essence the function of the board stacker is to support the boards in their horizontal position as they are displaced off the end of the conveyor and to form them into a neat stack of boards forming a lot which can then be strapped and wrapped up for dispatch and then transported to the site where they will be used.

Broadly the stacker 5 comprises a support 40, and also a vacuum conveyor 45 for supporting the boards as they run off the end of the conveyor 15 The conveyor releases the boards at the appropriate point depositing them on the existing stack of boards in the stacker.

The vacuum conveyor 45 is positioned above the stack of boards. It comprises an endless path or belt 47 with a plurality of longitudinally and laterally spaced vacuum cups 48 mounted along the length of the path. There are typically also a plurality of cups, eg 3 to 5, across the width of the belt. The vacuum cups attach to the board as it arrives at the packing point supporting its horizontal position and displacing it along until it is broadly in horizontal alignment with the remaining stack of boards. The board is then released by the vacuum cups and permitted to rest on the existing stack of boards.

Typically the conveyor has a feature that enables vacuum to be applied only to the cups extending along a certain length of the conveyor, ie that part engaging a board.

The board is detached from the vacuum conveyor by directing a blast of compressed air into the relevant cups. This force dominates the applied vacuum and releases the board. The conveyor may also have board position determining means, eg in the form of an opto-sensor or electronic eye, for sensing when the board should be released by the conveyor.

The conveyor also includes a self-lowering support between the conveyor 42 and cup 48 onto which the boards are placed. As the stack is built up the support is progressively lowered until the boards are supported on the conveyor. The support may be lowered by rotation of a pair of screw threaded shafts passing through a screw threaded bore in the support.

Figure 13:
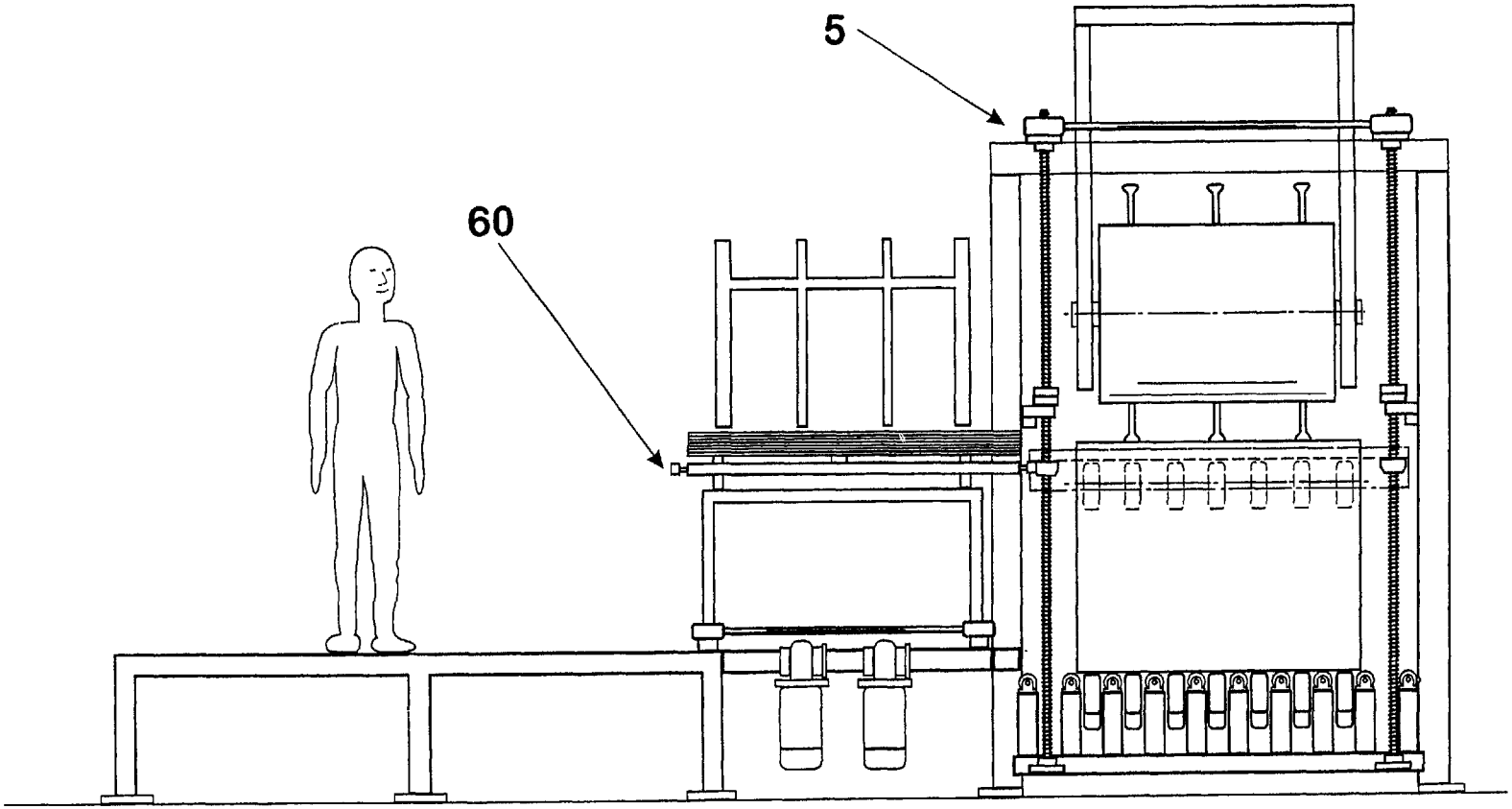
FIG. 13 is a front view of a glut inserter of FIG. 1.

FIG. 13 shows a glut inserter 60 for use with the board stacker described above.

As discussed above the different boards making up a pack are typically of different sizes and it is desirable to fill in the spaces formed by thinner boards with gluts or off-cuts. This helps to even out the weight distribution in the pack.

Gluts are standard pieces of board with a thickness and length complementing the boards in the pack and having a width of about 102 to 120 millimeters. Gluts fill in empty spaces in the pack and different packs will require different sized boards and a different number of gluts to fill in the empty spaces. Typically the gluts are 1200 to 1350 millimeters long, 100 to 120 millimeters wide, and 10 to 13 millimeters thick although clearly the widths will vary. The gluts are inserted from the one side as shown in FIG. 13. The spaces in the pack manifest on this side because the other side of the boards is aligned by the conveyor prior to the packing point as described above.

A cornice handler unit may be positioned adjacent the board stacker 5. The handler unit may be used to introduce a pack of cornices to the apparatus in the form of a load suitable for transport. This feature provides a way of using the apparatus to strap and wrap packs of cornices and deliver them conveniently to a point where they can be loaded onto a transport vehicle by a forklift. Optionally the cornice may be packed together with a pack of plasterboards.

The strapping applicator is used to wrap a sturdy strap around the pack to hold it together. The details of the strapping applicator 8 are not illustrated in any drawings. However strapping devices are well known in the art and used in a variety of industries and accordingly its structure and function would be well known in the art.

Figure 14:
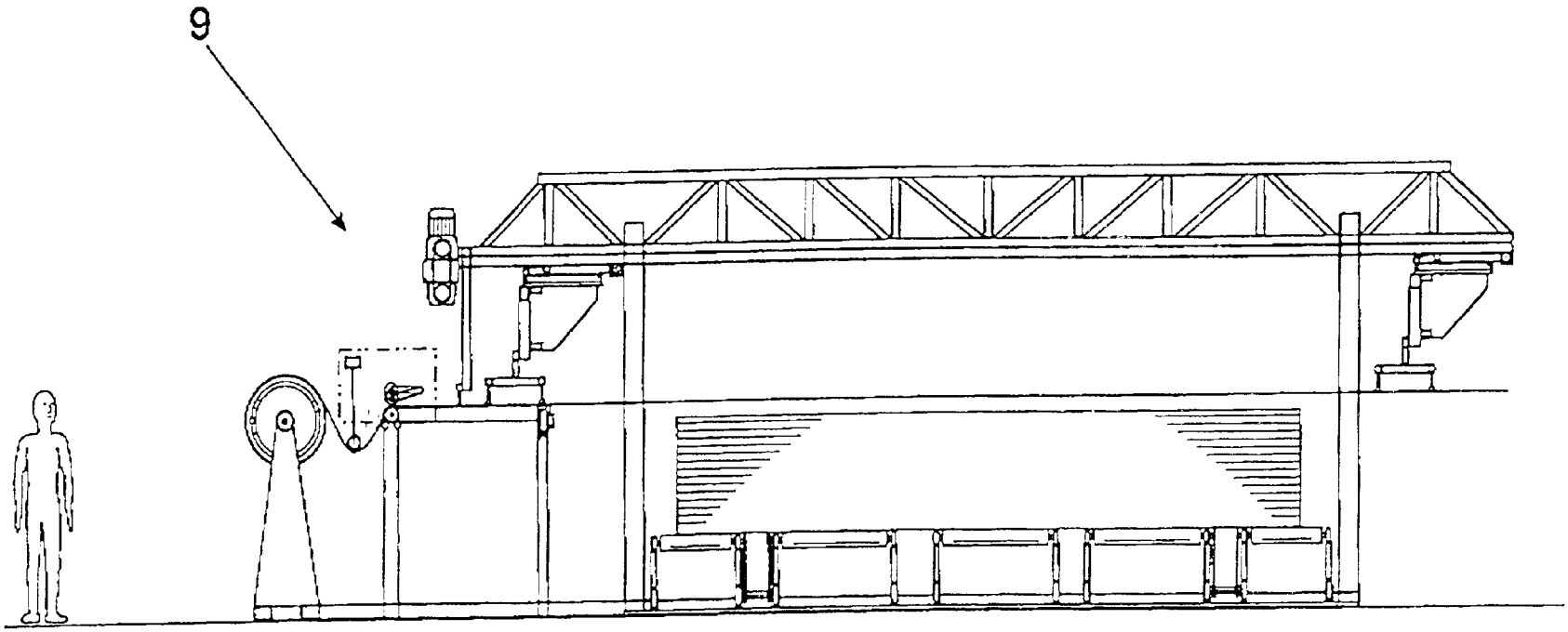
FIG. 14 is a plan view of a cover sheet applicator.

FIG. 14 illustrates a cover sheet applicator 9 of the apparatus of FIG. 1. The cover sheet 9 applicator may be positioned downstream of the strapping applicator 8. The cover sheet applicator is supplied with a roll of sheeting and a feeding mechanism for drawing sheet off the roll and across the top of the pack. This mechanism comprises a truss support with a rail and a sheet pulling carriage that is driven along the rail by means of a motor. The cover sheet is attached to the carriage by means of suction pads. The applicator also includes a tensioner for tensioning the sheet and a cutter for cutting the sheet. Thereafter the corners of the sheet are folded down and tucked.

Figure 15:
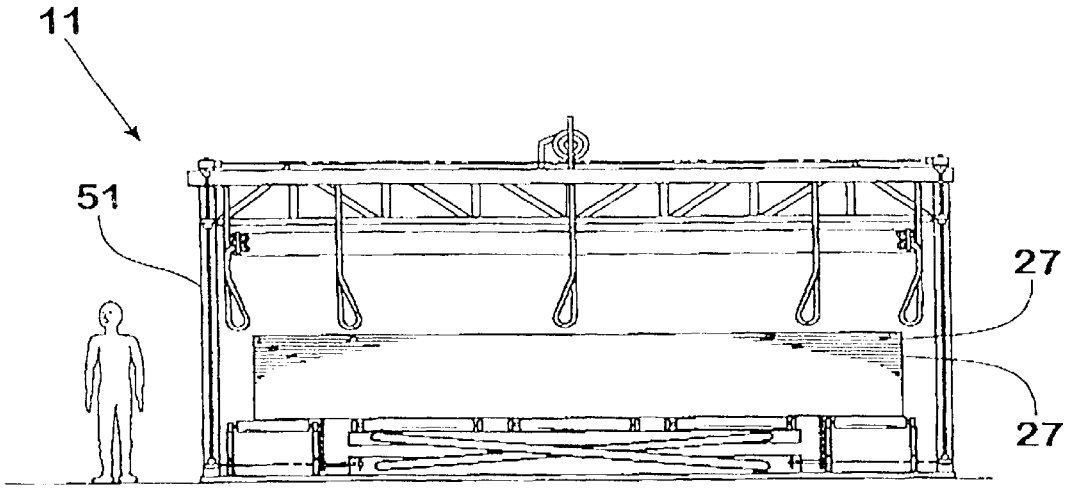
FIGS. 15 and 16 are front views of a shrink wrap applicator of FIG. 1 in different positions.
Figure 16:
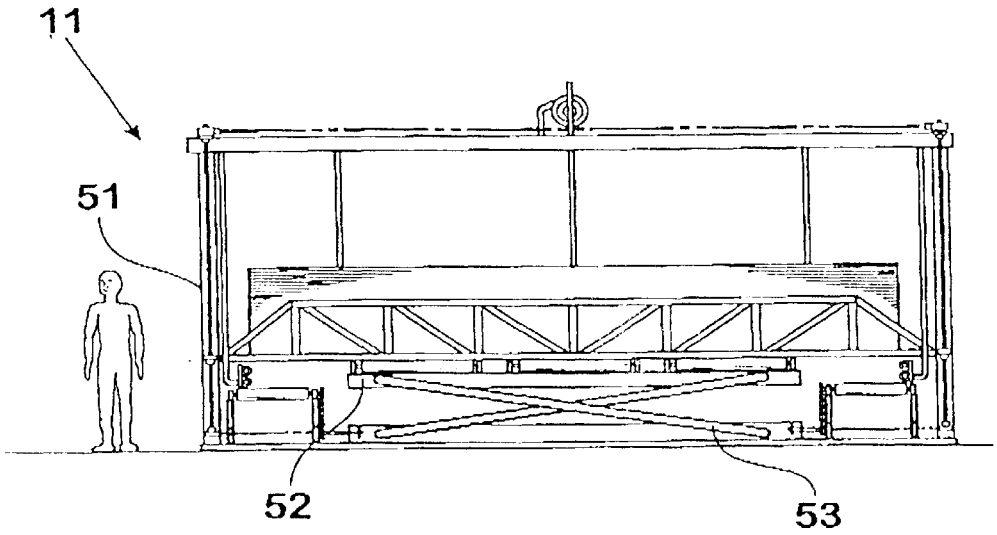

The pack is then advanced to the shrink wrap applicator 11. FIG. 15 shows the shrink wrap applicator of the apparatus of FIG. 1. The applicator 11 permits the sheet to be folded under the pack and then heat shrinks the sheet onto the pack. The applicator comprises broadly a framework 51 and a scissor lift 53 mounted on the framework 51 for lifting the pack as indicated in the drawings. Again the structure and function of an applicator for shrinking a cover sheet onto an article would be well known in the art.

The pack arrives at the shrink wrap applicator on the conveyor as shown in FIG. 6. Thereafter the scissor lift 53 raises the pack off the conveyor and the cover sheet placed on the pack at the cover sheet applicator can be folded underneath the conveyor. Hot air is then blown onto the cover sheet to shrink it tightly onto the pack. The pack is then lowered onto the conveyor and moved off to the discharge or dispatch point.

The shrink wrap does not fully enclose the pack underneath. To address this a blank board which is not ultimately used is placed at the bottom of the pack. Thus it does not matter if he bottom of the pack becomes wet or damaged.

In use an order for a lot of boards is received from a customer. The houselot will have a certain specification, ie a certain number of boards each with their own type, size and thickness specifications. An operator will key this information into the computer which then works out the appropriate sequencing or drawing of boards in the lot from the bins.

The apparatus then commences assembling the houselot by dispensing boards in turn from the appropriate bins and transferring them via the conveyor to the stacker 5. The stacker 5 stacks the boards one on top of each other in turn. Once all boards in the houselot are stacked, a further conveyor 12 is used to transfer the houselot to the strapping applicator 8. The houselot is sturdily strapped by the strapping applicator 8 to form a single article which can then be lifted.

The houselot is then conveyed to a cover sheet applicator 9 where it is covered by a cover sheet and then to a shrink wrap facility where it is wrapped in shrink wrap. The cover sheet and wrap is impervious as it is important to keep the pack dry during transport to the construction site. The final houselot is then presented at a transfer point for lifting onto a vehicle, eg by a forklift for transporting to the construction site.

Odd sized boards that are not contained in any of the bins can be loaded onto the bin conveyor at the point indicted for this purpose in FIG. 1. This enables these unusual sized boards to be inserted into the pack at the desired point.

An advantage of the apparatus described above is that it automates and mechanises the process of assembling house lots of board and producing a single pack or load which is lifted by a fork lift on to a truck for delivery to site. The apparatus substantially eliminates manual handling of boards from the bins right through to the loading point. It also effects assembling and packing the lot speedily and efficiently at low cost. A further advantage of the apparatus is its ability to assemble house lots that will satisfy 95% of orders for house lots from the 40 bins or storage units described above.

A yet further advantage is the ability of the apparatus to sequence or order the boards in the most appropriate order from both a point of view of packing the load and also the end user requirements. This confers substantial productivity advantages.

A yet further advantage is that some of the components used in the apparatus are well known components used in materials handling and can be bought off the shelf. Thus their reliability and functionality is well known and well understood. This will assist the reliability of the apparatus.

It will of course be realised that the above has been given only by way of illustrative example of the invention and that all such modifications and variations thereto as would be apparent to persons skilled in the art are deemed to fall within the broad scope and ambit of the invention as is herein set forth.

What is claimed is:

1. Apparatus for packing boards, the apparatus including:

a plurality of board storage units each storing a plurality of a specific size and specification of board, each board storage unit having means for dispensing a board in the board storage unit; and a conveyor for conveying the boards in sequence from the various board storage units to a packing point such that a lot or pack of boards can be formed at the packing point comprising boards of desired sizes arranged in a desired sequence.

2. Apparatus according to claim 1, wherein the apparatus also includes selector means for determining the sequence in which boards are drawn from the board storage units.

3. Apparatus according to claim 2, wherein the selector means controls dispensing of the boards by activating the appropriate board storage units in turn to dispense the boards.

4. Apparatus according to claim 3, wherein the selector means also includes a processing means that is a computer programmed with appropriate software for determining the sequence of boards in the pack or lot based on information entered into the computer.

5. Apparatus according to claim 4, wherein the apparatus has at least 20 said board storage units.

6. Apparatus according to claim 5, wherein the apparatus has 38 to 42 board storage units and wherein the board storage units are sized to accommodate boards having a length of 2.4 meters to 5–6 meters and a width of 1.2 meters to 1.35 meters.

7. Apparatus according to claim 1, wherein each board storage unit or bin is pivotable between a passive position in which the boards are horizontally extending and an active discharge position in which the boards are substantially vertically extending, and a leading board can be tipped or pushed on to the conveyor.

8. Apparatus according to claim 7, wherein the boards are loaded into each bin for subsequent use in forming a pack when the storage unit is in the passive position and after the loading is complete the unit is moved to the vertically extending operative position.

9. Apparatus according to claim 1, including advancing means for advancing the boards in the unit to a position where the leading board is in the leading position and can be tipped on to the conveyor, and wherein each board storage unit includes lifting means for lifting the board occupying a leading position upwardly such that an upper edge thereof projects upwardly proud of the remainder of the boards in the unit.

10. Apparatus according to claim 9, wherein the lifting means comprises a resilient biasing means for lifting the leading board upwardly proud of the remainder of the boards in the unit.

11. Apparatus according to claim 10, wherein the resilient biasing means is a spring and the biasing force is exerted more or less constantly on the board once the board is advanced to the leading position by the advancing means.

12. Apparatus according to claim 1, wherein each board storage unit includes dispensing means for detaching the leading board in the unit from the remainder of the boards and tipping the leading board onto the conveyor means.

13. Apparatus according to claim 12, wherein the dispensing means includes detaching means for detaching the raised leading board from the remainder of the boards and also tipping means for tipping the leading board onto the conveyor means.

14. Apparatus according to claim 13, wherein the detaching means includes a mechanical pusher for pushing the upper edge of the leading board in a direction away from the other boards and towards the conveying means.

15. Apparatus according to claim 14, wherein the tipping means includes a pneumatic plaster for issuing a blast of air at the upper edge of the leading board once it has been detached from the remainder of the boards to tip it onto the conveyor.

16. Apparatus according to claim 1, wherein the plurality of board storage units comprises two sets of storage units each of which comprises two rows of units with the conveyor means extending between the rows of units.

17. Apparatus according to claim 16, wherein the conveyor comprises a storage unit conveyor portion conveying the boards from the storage units to associated bin end points, a second conveyor portion conveying the boards laterally inwardly from said bin end points to a single transfer point, and a third conveyor portion conveying the board from the transfer point to the packing point.

18. Apparatus according to claim 17, wherein the storage unit conveyor portion include belts that are suited to grip and hold boards thereon when the boards are tipped onto the belts.

19. Apparatus according to claim 18, wherein the second conveyor portion comprises one or more laterally extending conveyor sections which comprises a plurality of spaced narrow belts for transporting the boards from the storage unit end points to the single transfer point.

20. Apparatus according to claim 19, wherein the third conveyor portion comprises transverse rollers rotated in a direction towards the packing point which transfer the boards from the transfer point to the packing point, and wherein the third conveyor portion also aligns the boards before they arrive at the packing point.

21. Apparatus according to claim 1, further including means for stacking the boards making up the pack or lot in a single stack with the boards broadly horizontally extending and substantially aligned with each other and with the boards stacked in the order in which they are drawn from the board storage units.

22. Apparatus according to claim 21, wherein the stacking means includes a support for supporting the boards forming the stack and also a vacuum conveyor mounted on the support spaced above the stacking means for attaching to the boards arriving at the packing point by means of a suction attachment and drawing the boards over the stacking means into a stacking position where the board is superimposed over the stack.

23. Apparatus according to claim 22, wherein the vacuum stacking conveyor releases the board attached thereto when the board is in the stacking position by interrupting the vacuum applied to the vacuum conveyor.

24. Apparatus according to claim 23, wherein the vacuum stacking conveyor comprises an endless conveyor with suction cups projecting outwardly therefrom at intervals across the surface of the conveyor, and wherein the suction cuffs apply a suction attachment to the boards when they come into contact therewith.

25. Apparatus according to claim 1, further including a pack transfer conveyor for conveying the pack of boards formed by the stacking means to a discharge point.

26. Apparatus according to claim 25, wherein the pack transfer conveyor is a roller conveyor comprising a plurality of closely spaced rollers extending transversely to the direction of travel of the pack and rotating in the direction of the travel of the pack to advance the pack from the stacking means to the discharge point.

27. Apparatus according to claim 25, further including means for attaching the pack of boards to each other to form a single article suitable for transport to a site where it is to be used.

28. Apparatus according to claim 27, wherein the attachment means comprises a strapping applicator positioned adjacent and downstream from the stacking means.

29. Apparatus according to claim 28, wherein the attachment means further includes means for applying a cover sheet to the pack to fully enclose or encase the pack to seal it off from the ingress of moisture downstream of the strapping applicator.

30. Apparatus according to claim 29, further including means for enclosing the pack in shrink-wrap to supplement the cover sheet.

31. Apparatus according to claim 30, including means for presenting the load conveniently for pick up by fork lift truck at the discharge point.

32. Apparatus according to claim 1, wherein the board storage unit includes:

a base;

a support for boards loaded into the storage unit, the support being mounted on the base;

means for pivoting the support between a passive position in which the boards are horizontally extending and an active discharge position in which the boards are vertically extending;

lifting means for lifting a leading board from those stored in the unit upwardly proud of the remainder of the boards when the unit is in the active discharge position; and dispensing means for dispensing the leading board from the support and onto a conveyor.

33. A board storage unit according to claim 32, wherein the units are generally positioned in the active discharge position during normal operation of the unit but which are moved to the passive position for loading of boards into this storage unit, and thereafter are moved back to the active discharge position.

34. A board storage unit according to claim 33, wherein the pivoting means comprises a hydraulic drive with a plurality of hydraulic rams.

35. A board storage unit according to claim 34, wherein the support member includes a first portion positioned under and supporting the boards in the passive position, and a second portion extending substantially perpendicularly to the first portion which is positioned underneath and supports the boards in the active position.

36. A board storage unit according to claim 33, wherein the lifting means comprises a resilient biasing means biasing the leading board upwardly proud of the remainder of the boards in the units.

37. A board storage unit according to claim 36, wherein the resilient biasing means is a spring positioned under the board in the leading position, and which applies a more or less constant force on the board in the leading position.

38. A board storage unit according to claim 33, wherein the dispensing means include detaching means for detaching the leading board from the remainder of the boards and also tipping means for tipping the leading board onto the conveyor means.

39. A board storage unit according to claim 38, wherein the detaching means include a mechanical pusher for pushing the upper edge of the leading board in a direction away from the other boards and towards the conveyor.

40. Apparatus according to claim 39, wherein the tipping means includes a pneumatic blaster for issuing a blast of air at the leading board once it has been detached from the remainder of the boards to tip it onto the conveyor.

41. Apparatus according to claim 40, wherein the unit further includes an overhead support member moveable relative to the bin towards and away from the conveyor, and the mechanical pusher and the pneumatic blaster are mounted on the support member in closely spaced relation to each other.

42. A method for assembling and wrapping a pack of boards so as to produce a single wrapped pack that can be transported to a building site, the method including:

selecting individual boards having specific dimensions in turn from a plurality of board storage units, each unit holding a specific size of board;

dispensing the selected boards from the board storage unit onto a conveyor as they are selected; and conveying the boards on the conveyor in the sequence in which they are selected and dispensed to a packing point where they can be stacked to form a pack of boards.

43. A method according to claim 42, further including the step of calculating a preferred order in which boards of different sizes are selected and then dispensed from the board storage units.

44. A method according to claim 43, further including the step of taking the boards off the conveyor as they are delivered to the packing point and depositing them onto a stack forming the pack of boards.

45. A method according to claim 44, wherein the boards are taken off the conveyor by stacking means including a vacuum conveyor.

46. A method according to claim 45, further including strapping the boards together to form a single pack after they have been formed into a stack.

47. A method according to claim 46, further including the step of covering the pack with a cover sheet and also with a shrink wrap.

48. A method according to claim 47, including the yet further step of transferring the strapped packed cover with a cover sheet and shrink-wrap to a transfer point where it can be picked up and deposited in a truck.

* * * * *